United States Patent [19]

Wallace

[11] Patent Number: 4,514,012

[45] Date of Patent: Apr. 30, 1985

[54] EXCAVATORY MACHINE FOR USE IN COAL AND OTHER MINING OPERTIONS

[75] Inventor: John L. Wallace, Woonona, Australia

[73] Assignee: Maintel Pty. Limited, New South Wales, Australia

[21] Appl. No.: 516,730

[22] Filed: Jul. 25, 1983

[30] Foreign Application Priority Data

Jul. 28, 1982 [AU] Australia ..... PF5092

[51] Int. Cl.[3] ..... E21C 27/24

[52] U.S. Cl. ..... 299/57; 299/31; 15/161

[58] Field of Search ..... 299/31, 33, 57, 61, 299/71, 76, 80, 75; 105/161, 29 R

[56] References Cited

U.S. PATENT DOCUMENTS 3,827,754 8/1974 Gilley ..... 299/31
4,027,918 6/1977 Hujimuri et al. ..... 299/71

FOREIGN PATENT DOCUMENTS 364689 1/1932 United Kingdom ..... 299/75
1347504 2/1974 United Kingdom ..... 299/71
1545588 5/1979 United Kingdom ..... 299/80

*Primary Examiner*—Stephen J. Novosad
*Assistant Examiner*—Mark J. DelSignore
*Attorney, Agent, or Firm*—Pearne, Gordon, Sessions, McCoy, Granger & Tilberry

[57] ABSTRACT

An excavatory machine for use in coal and other mining, has a pair of rotary cutters for simultaneous presentation to the work. The cutters are mounted on the ends of a medially fulcrumed lever which can be swung about its fulcrum so to increase the work ambit of the combined cutters. The fulcrum has means for raising and lowering it and holding it at selected elevation so to suit the height of the seam being worked. The cutter assembly is mounted on a saddle which is laterally slidable and drivable from side-to-side of a base slidable along the excavation floor in the direction the work is required to follow. This base is furnished with means enabling it to be nudged along in the said direction so to force the cutters into the work.

The base is provided with conveyor means to take away excavated matter and also with mechanism by which the path followed by the base may be up-or down-trended.

25 Claims, 9 Drawing Figures

EXCAVATORY MACHINE FOR USE IN COAL AND OTHER MINING OPERTIONS

This invention relates to excavatory machines of the kind used in the mining of mineral matters such as coal.

Primarily, the machine subject hereof is intended for use as what, in the art, is known as a heading machine; that is, a machine for driving passages or "roadways" into a seam to be excavated; however, it may be used for excavation purposes generally, either underground or open-cut.

Again, use of the present machine is not confined to the mining of coal, but as the invention is primarily intended for use in roadway cutting in underground coalmining, it will be described herein mainly in terms of an embodiment of the invention designed to serve that specific purpose.

Coal deposits occur in seams whereof the thickness, or depth, may (not invariably, but commonly) run from one to several meters, and when the seam has been initially shafted a heading machine is tunnelled into it laterally, somewhat in the manner (using a machine-tool analogy) of a large-scale end-mill, thus to drive a passage or "roadway" into the seam.

Once a roadway is started, the machine is inchingly advanced along it so to extend the roadway by sustained, forcible presentation of the cutting elements of the machine to the progressively exposed blind end-face of the seam. This is accompanied by conveyance of the coal thus excavated back towards the roadway starting point.

The width of a roadway is not usually a critical dimension. It may, for example, be between 4 and 5.5 meters. It is usually selected on the basis of suitable mechanical design for the machine as a whole, operatives' welfare, the necessities of excavated coal conveyance, roof bolting and so on. On the other hand, the height required of a roadway can give rise to certain disabilities which it is the purpose of the present invention to remedy.

In many coalmines (notably in the United Kingdom) seam thicknesses can be remarkably close to uniform; and, that being the case, it is a simple matter (and a frequently occurring one) to design a heading machine to suit that particular seam thickness. In other cases however (especially in some Australian coalmines, for example) seam thicknesses may vary extensively, not only as between different seams, but between different parts of the same seam, or in the course of a single excavatory run within it.

Thus, a major object of the present invention is to provide a heading machine wherein the working ambit of the coal-cutting tools employed may be varied so as to be brought into correspondence with a selected seam thickness within a relatively wide range thereof; either prior to roadway formation or during the course thereof.

Other shortcomings of the prior heading machines (which the present invention is intended to ameliorate) are that they are expensive, and they are bulky, in some cases to the extent of not providing adequate access space for roof rock-bolting in sufficiently close follow-up to excavation.

The coat-cutter tools employed by the present machine are of the same type as commonly used on prior heading machines; each such tool being in the form of a rotary drum structure carrying an annular array of picks which tear the coal from the face. The, or each, drum is rotatably mounted on the machine so as to be presented axially to the end face of the roadway in the manner of an end-mill and is rotated by way of known drive mechanism which preferably (as is customary) in its hub formation, includes an epicyclic reduction gear train.

The present invention employs conventional type cutter tools, but an important characteristic resides in its way of using them. By this invention two such tools are used in tandem, and each of these has a working face area which is fractional relative to the area of the blind-end face of the roadway to be cut. The tandem cutters, although individually of relatively small working face area relative to the roadway end face to be excavated, perform the required excavation because they are so mounted on the machine as to be capable of translational migration within the blind-end face area; and this, within any such area whereof the height is selected to accord with the thickness of the seam under attention.

In summary, the invention provides an excavating machine, for use in a mine presenting a face from which work is commenced and sustained, said machine consisting of a machine base structure, means to advance said base structure along the floor of the mine and towards said face, and a cutter-head assembly mounted on said base structure for excavatory presentation to said face, said machine comprising:

a saddle mounted on and reciprocatable from side-to-side of said base structure, means on said structure to reciprocate said saddle as aforesaid, a first lever fulcrumed by one end on said saddle, means for varying the angular disposition of said first lever relative to said saddle and for holding it in selected angular disposition relative to said saddle, a second lever medially fulcrumed on the free end of said first lever, means for part rotating said second lever between angularly spaced-apart positions therefor and for holding said second lever in a selected one of those positions, and a pair of power-rotatable cutters respectively borne on the ends of said second lever.

An example of the invention is illustrated in the drawings herewith.

All of the figures are largely diagrammatic, and this applies particularly to FIGS. 4 to 7. In this connection, a number of essentially-present items of conventional kind are omitted; for example, the cutters would normally be equipped with guard plates for safety purposes and to guide excavated coal in the general direction of the means for its collection. In other respects the drawings are intended to convey the substance of the invention rather than a detailed apparatus ready for practical application.

Figure 1:
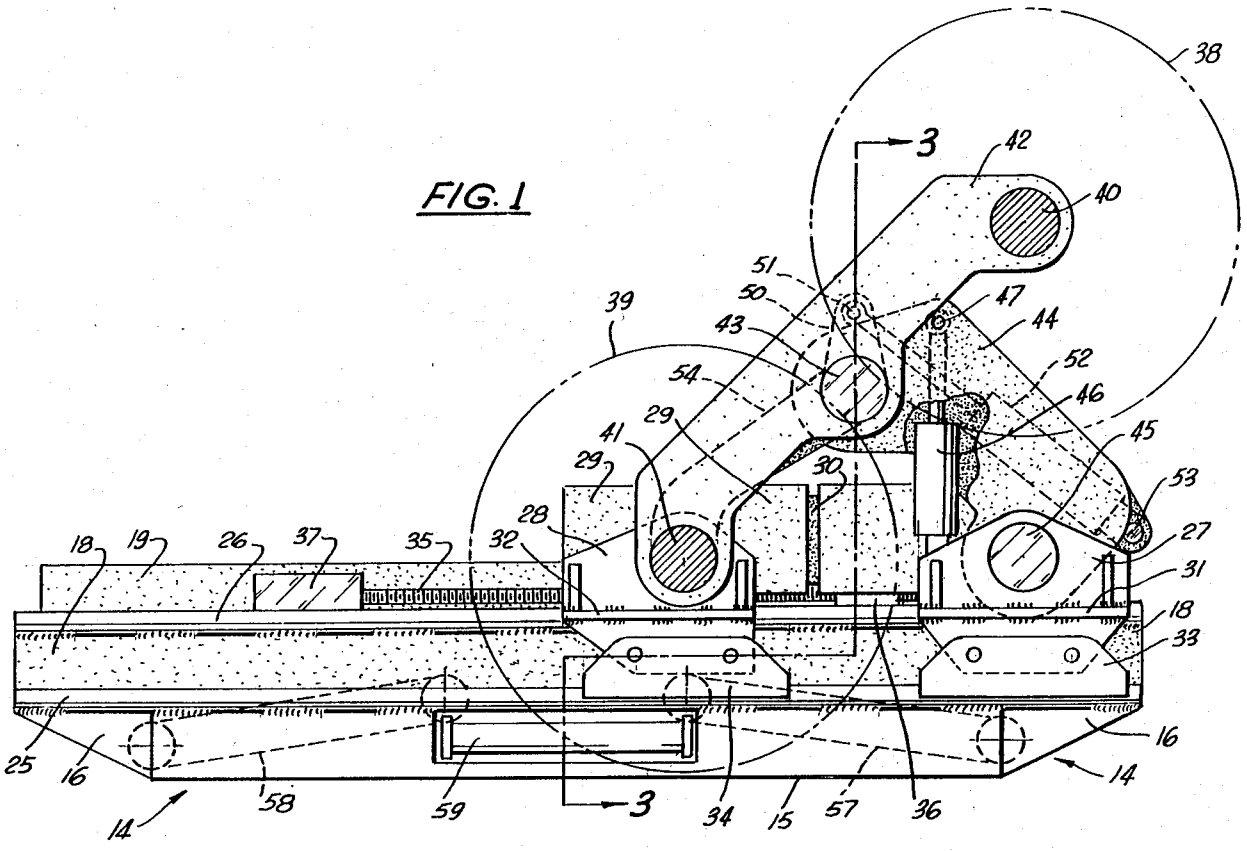
FIG. 1 is a front elevation of a heading machine.
Figure 2:
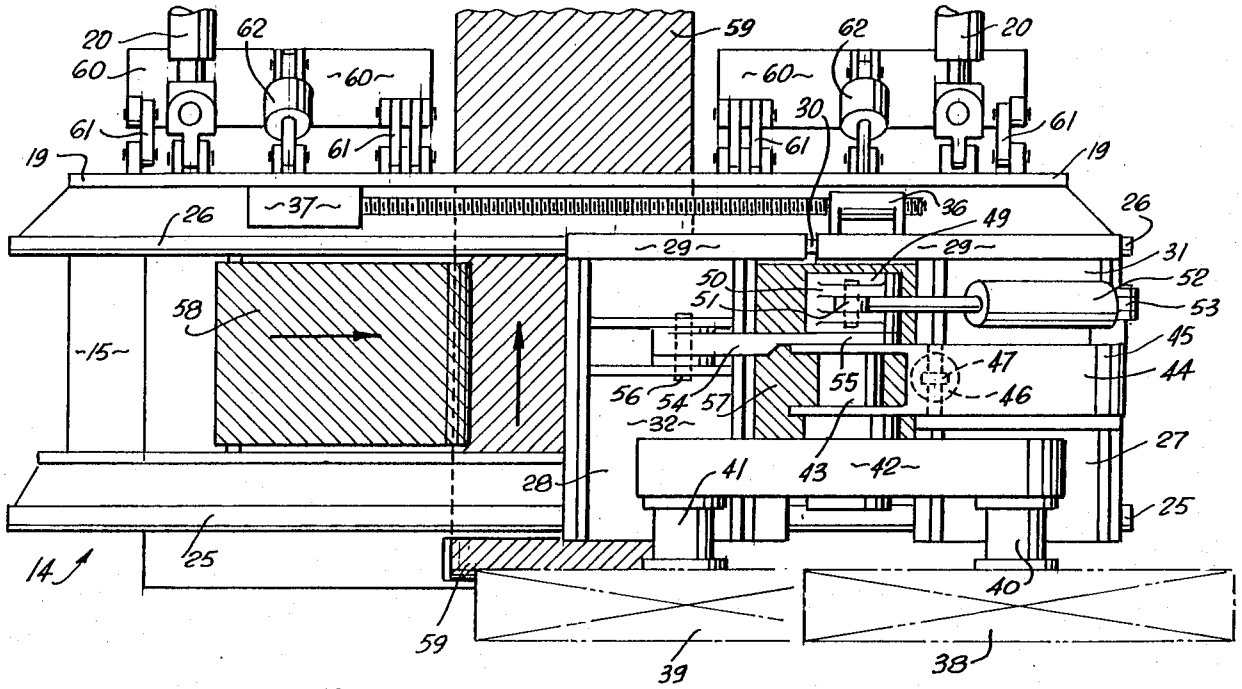
FIG. 2 is a plan projected from FIG. 1.
Figure 7:
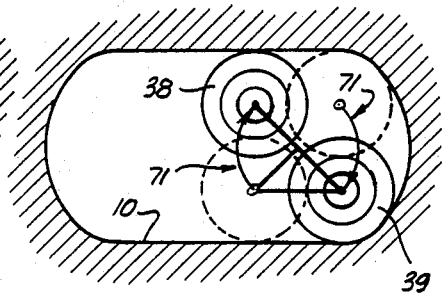

The illustrated machine is shown in course of excavating a roadway whereof the lateral cross-sectional shape is indicated by the oval marked 10 in FIG. 7. The roof, floor and blind-end face of the roadway are respectively indicated at 11, 12 and 13 in FIG. 3. It may be noted that in FIG. 1 one is looking at the machine as though viewing it from the blind-end face 13. FIGS. 4 to 7 are directed in the reverse sense; that is, towards face 13.

As previously intimated, an important aspect of the present invention resides in its migratory cutter-assembly arrangements, and hence the general machine structure is of more-or-less conventional design, but not entirely so because that design is affected by the nature of the cutter-assembly.

This is because the ability of the cutters to sweep an area (the road cross-sectional area) which is several times greater than their own projected area, enables the remainder of the machine to be exceptionally small and compact by comparison with prior heading machines for excavation of a roadway of equal cross-sectional area. One important advantage which flows from this compactness is that roof-bolting may be applied almost immediately following roof formation. For example with the illustrated machine (one able to excavate a roadway almost 5 meters wide and over 3 meters high) roof-bolt application can be conventionally performed within 2 meters of the blind end-face 13.

The machine base structure 14 includes a bottom skid plate 15 which rests, but is slidable, on floor 12; and a number of support members such as 16, 17, 18 and 19.

Structure 14 has the rest of the machine, including its cutter-head assembly, mounted thereon as explained later herein.

More-or-less conventional means are provided for advancing the base 14 along floor 12 in the direction towards face 13. These advancement means consist of a pair of jacks or rams 20 mounted on a sled 21 which rests, but is slidable, on floor 12. This sled is coupled by upright supports 22 to an abutment plate 23 able to bear against roof 11. These supports may be hydraulic cylinders or other elevators. Preferably they are of the kind known as being of lemniscate linkage type, and a separate jack or ram 24 is provided for use as a thrust member.

Sled 21 and plate 23 can be thrust apart by operation of ram 24 to jamb tightly between roof 11 and floor 12 thus to provide an anchorage from which the base 14, and hence the cutter assembly mounted on it, may be forcibly thrust into the face 13 by operation of rams 20. When rams 20 are fully extended plate 15 is lowered to clear the roof 11 and sled 21 moved up to base 14. A fresh anchorage is then established as before, so to enable a further advancement of base 14.

The base 14 carries a pair of parallel runway rails 25 and 26 which extend from side-to-side of the base; that is, in the horizontal direction normal to the advancement locus of the machine.

Rails 25 and 26 are slidably ridden by a saddle. This saddle may be in one piece as later explained herein. Preferably, it is in two parts 27 and 28. These parts each have a socket sleeve 29 fixed on it and these two sleeves are co-aligned and longitudinally penetrated, in a close-fitting manner, by the respective end portions of a locator bar or plug 30. Plug 30 is fixed in one of the sleeves 29 while being slidable in the other. That other sleeve is then provided with means (not shown) whereby the plug end slidable therein may be fixed in the sleeve at selected telescopic adjustment relative thereto, thus to transform the two sleeves plus the plug into a rigid, in effect, one-piece link. The fixing means may be grub or set screws threading through one side of the sleeve and able to bear tightly against the plug; or, the sleeve or the plug may be provided with a hole able to register with a selected hole of a series thereof provided in the plug or sleeve concerned (as the case may be) and into which a retention pin or bolt may be inserted.

When both ends of plug 30 are fixed in relation to the two sleeves 29 (in selected telescopic adjustment) the two parts 27 and 28 become (in effect) a one-piece saddle and slidably movable as such along the rails 25 and 26.

To this end the two saddle parts 27 and 28, which have the two sleeves 29 respectively fixed on them, include base plates 31 and 32, and shoes 33 and 34 which slidably rest on rails 25 and 26 respectively.

The two-part saddle may be transversed, moving as one piece, from side-to-side of the base 14 by several different forms of drive mechanism. For example, the saddle portion 27 may be furnished with a motor-driven gear pinion which meshes a rack fixed on base 14. Again, this drive may be by way of a sprocket chain which meshes and runs round pinions at opposite sides of the base 14 and has both of its ends anchored to saddle part 27; one of the pinions being suitably motor driven when the saddle is to be moved from one side of the base to the other.

For preference the drive mechanism for the saddle is as shown in the drawings, where it consists of a lead-screw 35 which threads in a nut 36 mounted on saddle part 27 (or rather the sleeve 29 of that part) and is rotatable by a motor indicated at 37.

Figure 3:
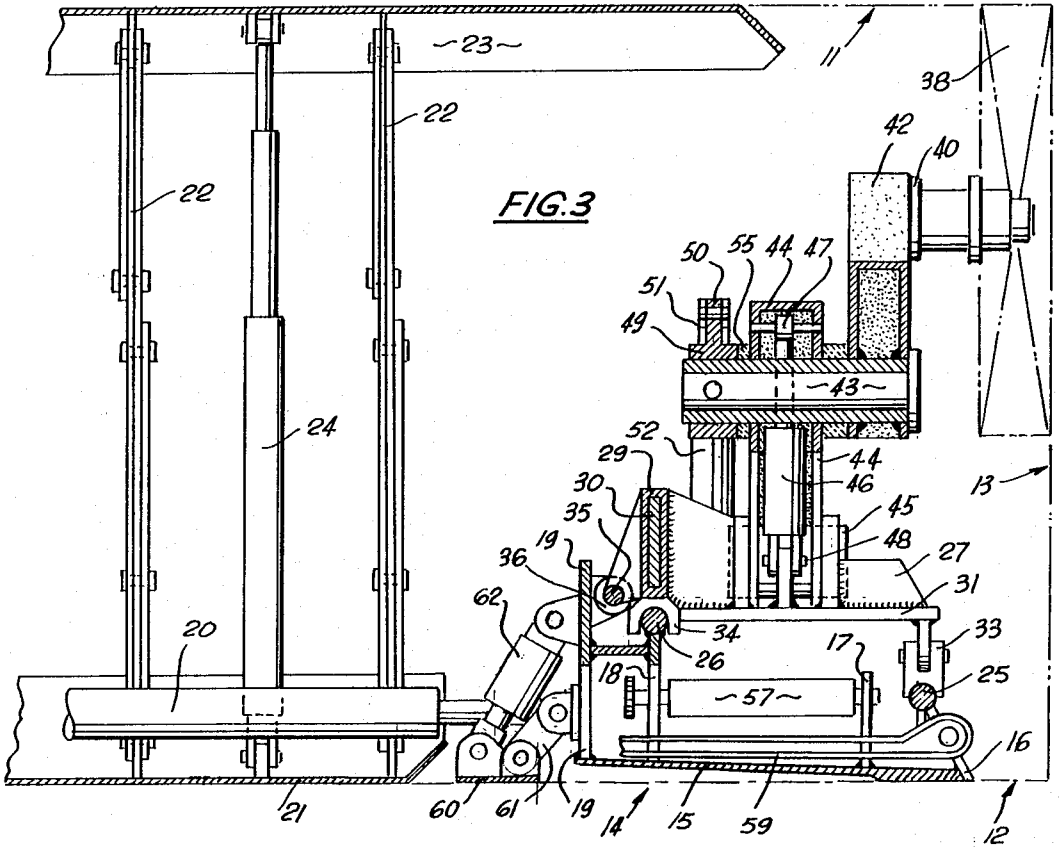
FIG. 3 is a sectional side elevation taken on line 3—3 in FIG. 1.

The cutter assembly comprises a pair of rotary cutter drums 38 and 39 drive-rotatably borne (at 40 and 41) on the respective ends of a lever 42 medially fulcrumed at 43 on the free end of a lever 44 fulcrumed by its other end (at 45) on saddle-part 27. An "elevator" ram 46 has its upper end pivoted (at 47) to lever 44. The lower end of this ram is similarly pivot-connected to saddle part 27 at 48 (FIG. 3).

This ram (46) enables fulcrum point 43 to be raised or lowered depending on the height, or excavatory vertical span, under which the machine is required to operate, having regard to the height of the seam to be worked. In the drawings generally, and FIGS. 1 and 3 to 7 in particular, the cutter drums 38 and 39 are at maximum excavatory span. If fulcrum point 43 is lowered sufficiently as to bring the axes at 40 and 41 into the same horizontal plane, the machine is then at minimum vertical excavatory span; that is, with a span substantially equal to the diameter of a single cutter drum.

The fulcrum pin at 43 has lever 42 and also a boss 49 keyed on it. This boss mounts a crank throw 50 to which one end 51 of a "throw-over" ram 52 is pivoted. The other end of this ram is pivoted at 53 on a bracket fixed on and projecting from lever 44 adjacent its fulcrumed end.

Saddle portion 28 is connected to fulcrum pin 43 by a link 54 which has one end 55 freely pivoted on pin 43 and its other end freely pivoted on saddle portion 28 at 56.

Figure 4:
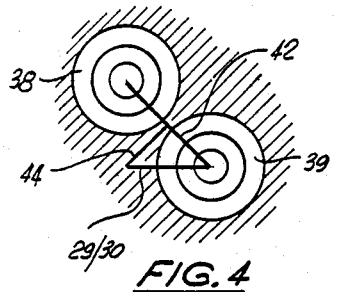
FIGS. 4 to 7 show progressive steps in a roadway tunnel cut.
Figure 5:
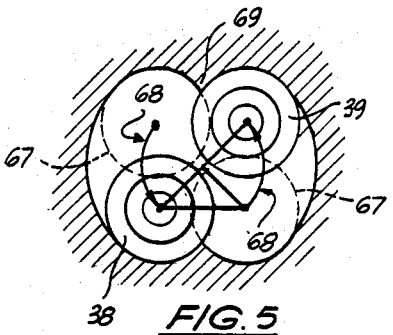
Figure 6:
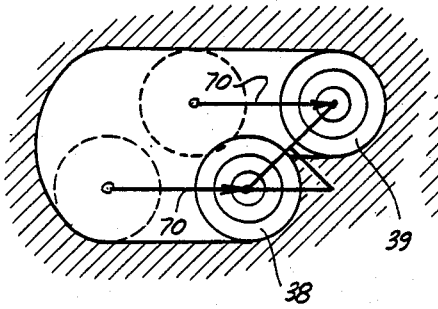

The throw-over ram 52 is operable to change the operating modes of the two cutter mills 38 and 39, each relative to the other, to or from that shown (for example) in FIG. 4 or FIG. 5.

Excavated coal is guided (in conventional manner) to fall on to a pair of transverse feeder conveyors 57 and 58 and these are equipped and operated (also as is well known) to deliver the coal received by them onto a main conveyor 59 whereof the top or carrier flight runs in the direction opposite to that of machine advancement, thus to clear away the excavated coal as it accumulates.

It will be appreciated that it is desirable for the floor 12, formed by excavation, substantially to coincide with the bottom of the seam or some other level as may be required; and that the machine's progress may erratically depart from the required path, or the seam itself may take an upward or downward tilt.

The machine subject hereof includes means enabling correction of such mis-trendings. These means consist in at least one corrector skid operable to down-tilt or up-tilt the direction in which the machine is heading. In the illustrated arrangement two corrector skids 60 are provided. These are in the form of plates able to ride the floor 12. Skids 60 are connected to base 14 by inextensible links 61 and also by length adjustable links in the form of rams 62.

When the advancement direction is to be down-trended, links 62 are appropriately extended, and for up-trending they are shortened. To facilitate this up-trending, the trailing majority of the under face of skid-plate 15 is preferably relieved as indicated at 15A so as to provide mechanical clearance enabling the up-trending action to start promptly.

Figure 8:
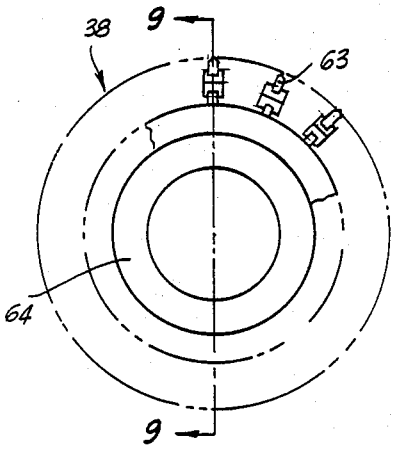
FIG. 8 is an incomplete front view of a typical cutter drum.
Figure 9:
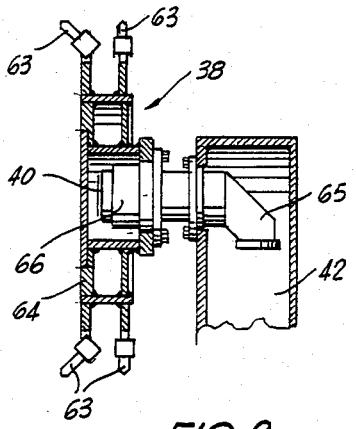
FIG. 9 is a section taken on line 9—9 in FIG. 8.

The cutter drums 38 and 39 are, as already intimated, of common type; each consisting of a circular array of variously directed picks 63 (see FIGS. 8 and 9) mounted on a drum structure as indicated at 64. These drums are rotated in known manner; for example, by way of a fluid drive unit 65 and an epi-cyclic reduction gear-box 66.

Assuming a roadway is to be driven into a seam, the cutter assembly is brought into confrontation with the roadway starting site. Assuming further that the cutters are still positioned as they were at the end of a previous working pass, then the confrontation may be regarded as represented by FIG. 4, the cutter drums being in "mode A". Advancement of the machine into the face will then cause two circular cavities to be cut. These two cavities (67 in FIG. 5) are then laterally extended by operation of ram 52 (FIG. 1) so that the cutters follow arrows 68 to assume mode "B" as shown in FIG. 5. This will leave an unexcavated cusp at 69. The cutter drums, still in mode B, are moved (as shown by arrows 70 in FIG. 6) by operation of lead screw 35, until they reach the limit position shown by full lines in FIG. 6.

The cutters are then reverted to mode A (as shown in full lines in FIG. 7) by following arrows 71 as shown in that figure. To complete the working pass the cutters (as shown in FIG. 7) are travelled back to the start position as shown in FIG. 4, and in doing so excavate cusp 69.

It will be understood that the machine as described above may be varied extensively yet remain within the scope of the invention. For example, the second saddle part 28 and link 54 could be omitted. Lever 44 would then rely wholly on ram 46 not only to swing it about its fulcrum 45 but also to hold it in selected angular adjustment. Even so, the arrangement shown is much to be preferred since the stresses imposed on the machine parts, particularly lever 42 and its fulcrum arrangements, are very great, therefore it is desirable for fulcrum pin 43 to be borne at the apex of the sturdy, rigid triangle represented by lever 44, link 54 and the sleeves 29 when they are fixedly held, each to the other, by way of plug 30.

It will be noted that the ends of the oval marked 10 in FIG. 7 are pronouncedly arcuate. This degree of curvature will result if the fulcrum 43 is stationary while the cutter drums are changing from one mode to the other as described above; that is to say, drum 39 moves from the position shown for it in FIG. 6 to that shown for it in FIG. 7. This pronounced curvature flows from the fact that wheel 39 descends along a circular path centred in fulcrum 43.

In some cases roadway end curvature of the kind shown in FIG. 7 is not objectionable; in others however, it is desirable to reduce this curvature (for example, for better efficiency, in roof support by propping, bolting or otherwise). In other words, to make the shape of the "oval" more nearly rectangular.

This can be effected with the apparatus subject hereof by arranging for the fulcrum axis at 43 to recede from the end of the "oval" (at which the mode changeover is taking place) during the first half of the downward movement of wheel (39) and to advance it back towards that end during the second half of that movement.

This recession of the fulcrum followed by its restoration can be carried out by use of the lead screw 35 to shift the whole saddle assembly, and necessarily the fulcrum point of lever 42, away from the end being worked, for recession; and then reversely for restoration.

The roadway being cut must necessarily have rounded corners due to the circularity of the cutter drums, but by appropriate use of lead screw 35 as described, the end of the cut tangent to the two rounded corners, may be brought into close approximation to upright rectilinearity.

It scarcely needs mentioning, but in accordance with normal practice in the mining machinery art, all of the motors and rams used in the instant machine are preferably hydraulically operated.

I claim:

1. An excavatory machine, for use in a mine presenting a face from which work is commenced and sustained, said machine consisting of a machine base structure, means to advance said base structure along the floor of said mine and towards said face and a cutter-head assembly mounted on said base structure for excavatory presentation to said face, said machine comprising:

a saddle mounted on and reciprocatable from side-to-side of said base structure and having two interconnected parts adjustably spaced apart, said parts having means to hold them in selected adjustment of one relative to the other, means applied to one of said parts to reciprocate said saddle as aforesaid, a first lever fulcrumed on said one of said parts, means for varying the angular disposition of said first lever relative to said saddle and for holding said first lever in selected angular disposition relative to said saddle, a second lever medially fulcrumed on the free end of said first lever, the other of said parts being linked to the fulcrum of said second lever, means for part rotating said second lever between angularly spaced-apart positions therefor and for holding said second lever in a selected one of those positions, and a pair of power-rotatable cutters respectively borne on the ends of said second lever.

2. A machine according to claim 1 wherein the means to reciprocate said saddle comprise:

parallel runway rails mounted on said base structure and along which said saddle is slidable, a motor-driven lead screw borne on said base structure with its axis parallel to said rails, and a nut mounted on said saddle and threaded on said lead screw.

3. A machine according to claim 1 wherein the means for varying the angular disposition of said first lever consist of a hydraulic ram pivoted by one end to said first lever and pivoted by its other end to said saddle.

4. A machine according to claim 1 wherein the means for varying the angular disposition of said first lever consist of a hydraulic ram pivoted by one end to said first lever and pivoted by its other end to that one of said saddle parts upon which said first lever is fulcrumed.

5. A machine according to claim 3 wherein the means for holding said first lever is selected angular disposition consist wholly of said hydraulic ram.

6. A machine according to claim 4 wherein the means for holding said first lever in selected angular disposition comprise: a link whereby the fulcrum of said second lever is coupled to that one of said saddle parts upon which said first lever is not fulcrumed.

7. A machine according to claim 3 or claim 5 wherein the means for part-rotating said second lever comprise: a crank throw fixed to said second lever about its fulcrum axis, and a hydraulic ram pivoted by one end to said crank throw and by its other end on said saddle.

8. A machine according to claim 5 or claim 6 wherein the means for part-rotating said second lever comprise: a crank throw fixed to said second lever about its fulcrum axis, and a hydraulic ram pivoted by one end to said crank throw and by its other end to said first lever adjacent its fulcrum.

9. A machine according to any one of the preceding claims 1 or 2 through 6 which includes means for removal of excavated material comprising a main conveyor whereof the carrier flight runs in the direction opposite to that of machine advancement, and a pair of transverse feeder conveyors able to discharge excavated material onto said main conveyor at opposite sides thereof.

10. A machine according to any one of the preceding claims 1 or 2 through 6 which includes means for up-trending or down-trending said base structure comprising: at least one skid able to ride the mine floor and connected to said base structure by an inextensible link and a hydraulic ram.

11. A machine according to any one of the preceding claims 1 or 2 through 6 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

12. A machine according to claim 7 which includes means for removal of excavated material, comprising a main conveyor whereof the carrier flight runs in the direction opposite to that of machine advancement, and a pair of transverse feeder conveyors able to discharge excavated material onto said main conveyor at opposite sides thereof.

13. A machine according to claim 8 which includes means for removal of excavated material, comprising a main conveyor whereof the carrier flight runs in the direction opposite to that of machine advancement, and a pair of transverse feeder conveyors able to discharge excavated material onto said main conveyor at opposite sides thereof.

14. A machine according to claim 12 which includes means for up-trending or down-trending said base structure, comprising: at least one skid able to ride the mine floor and connected to said base structure by an inextensible link and a hydraulic ram.

15. A machine according to claim 13 which includes means for up-trending or down-trending said base structure, comprising: at least one skid able to ride the mine floor and connected to said base structure by an extensible link and a hydraulic ram.

16. A machine according to claim 7 which includes means for up-trending or down-trending said base structure, comprising: at least one skid able to ride the mine floor and connected to said base structure by an inextensible link and a hydraulic ram.

17. A machine according to claim 8 which includes means for up-trending or down-trending said base structure, comprising: at least one skid able to ride the mine floor and connected to said base structure by an extensible link to a hydraulic ram.

18. A machine according to claim 12 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

19. A machine according to claim 13 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

20. A machine according to claim 14 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

21. A machine according to claim 15 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

22. A machine according to claim 16 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

23. A machine according to claim 17 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

24. A machine according to claim 7 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

25. A machine according to claim 8 which includes means to advance it along a mine floor, consisting of a sled slidable along said floor, an abutment plate able to bear against a roadway roof, means for thrusting said sled and said plate apart, and at least one hydraulic ram mounted on said sled and able to thrust the machine towards said face.

* * * * *